US006268039B1

(12) United States Patent
Chou et al.

(10) Patent No.: US 6,268,039 B1
(45) Date of Patent: Jul. 31, 2001

(54) PACKING BUFFER ASSEMBLY

(75) Inventors: Ming-Hsun Chou; Shu-Chin Chen, both of Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 09/557,773

(22) Filed: Apr. 25, 2000

(51) Int. Cl.[7] ..... B65D 81/02

(52) U.S. Cl. ..... 428/122; 428/80; 206/453; 206/586; 206/583

(58) Field of Search ..... 428/122, 80; 206/583, 206/594, 453, 449, 586

*Primary Examiner*—Alexander S. Thomas
(74) *Attorney, Agent, or Firm*—Pillsbury Winthrop LLP

(57) ABSTRACT

A packing buffer assembly includes a pair of sleeves and an accessory supporting plate. Each sleeve has a first buffer member, a pair of second buffer members mounted on the first buffer member in a wedging manner, and a pair of shoulder pads. Each first buffer member has a pair of upper and lower plates, a side plate, and a first receiving space. The shoulder pads of each sleeve are disposed in the first receiving space. Each second buffer member has upper and lower end portions. The accessory supporting plate has a central part, a pair of risers, a second receiving space which is defined by the central part and the risers, and a pair of wings which extend oppositely and respectively from the risers so as to be laid on the sleeves.

6 Claims, 8 Drawing Sheets

PACKING BUFFER ASSEMBLY

BACKGROUND OF THE INVENTION

1. Field of the Invention

This invention relates to a packing buffer assembly for holding and providing shock protection to a computer and accessories of the computer in a packing case.

2. Description of the Related Art

FIGS. 1 and 2 illustrate a conventional packing buffer assembly for a notebook computer 13 in a packing case 14. The packing buffer assembly includes a pair of buffer sleeves 11 which receive two opposite sides of the notebook computer 13 for providing buffering function in the packing case 14 to protect the notebook computer 13 from shock. The packing buffer assembly further includes an inner case 12 for receiving accessories of the notebook computer 13, such as external disk drivers, program disks, manuals, power cords, batteries, and the like. The buffer sleeves 11 and the inner case 12 are arranged side-by-side in the packing case 14. Two opposite spaces 15 are formed respectively between one side of the notebook computer 13 and the inner case 12 and between the other side of the notebook computer 13 and the packing case 14. The use and the arrangement of the inner case 12 in the packing case 14 result in an unnecessary increase in the volume of the packing case 14. Moreover, the spaces 15 formed in the packing case 14 can not be utilized efficiently.

SUMMARY OF THE INVENTION

Therefore, the object of the present invention is to provide a packing buffer assembly that dispenses with the aforesaid inner case and that is capable of reducing the volume of the aforementioned packing case.

According to the present invention, a packing buffer assembly is adapted to hold and to provide shock protection to a computer and accessories of the computer in a packing case, and comprises: a pair of spaced apart sleeves adapted to receive two opposite sides of the computer, each of the sleeves having a horizontally extending substantially U-shaped first buffer member, a pair of vertically extending substantially U-shaped second buffer members mounted respectively on two opposite ends of the first buffer member in a wedging manner, and a pair of shoulder pads, the first buffer member of each of the sleeves having a pair of horizontally extending upper and lower plates which are aligned and substantially parallel to each other, a vertically extending side plate which interconnects the upper and lower plates, and a horizontally extending first receiving space that is confined by the upper and lower plates and the side plate, the shoulder pads of each of the sleeves being disposed in two opposite ends of the first receiving space for spacing and propping the upper and lower plates, the second buffer members of each of the sleeves being fitted over the first buffer member at one side of the side plate opposite to the first receiving space, and having upper and lower end portions that respectively project upwardly and downwardly from the upper and lower plates of the first buffer member, and intermediate notches formed between the upper and lower end portions, the first buffer member of each of the sleeves being inserted fittingly into the intermediate notches of the respective pair of the second buffer members, the first receiving spaces of the first buffer members being adapted to receive respectively the opposite sides of the computer; and an accessory supporting plate spanning the sleeves and having a horizontally extending central part which is adapted to be aligned above and disposed adjacent to the computer, a pair of vertically extending risers which extend respectively and upwardly from two opposite sides of the central part, a second receiving space which is defined by the central part and the risers and which is adapted to receive the accessories of the computer, and a pair of horizontally extending wings which extend oppositely and respectively from the risers so as to be laid on the sleeves.

BRIEF DESCRIPTION OF THE DRAWINGS

In drawings which illustrate embodiments of the invention.

DETAILED DESCRIPTION OF THE PREFERRED EMBODIMENTS

Figure 1:
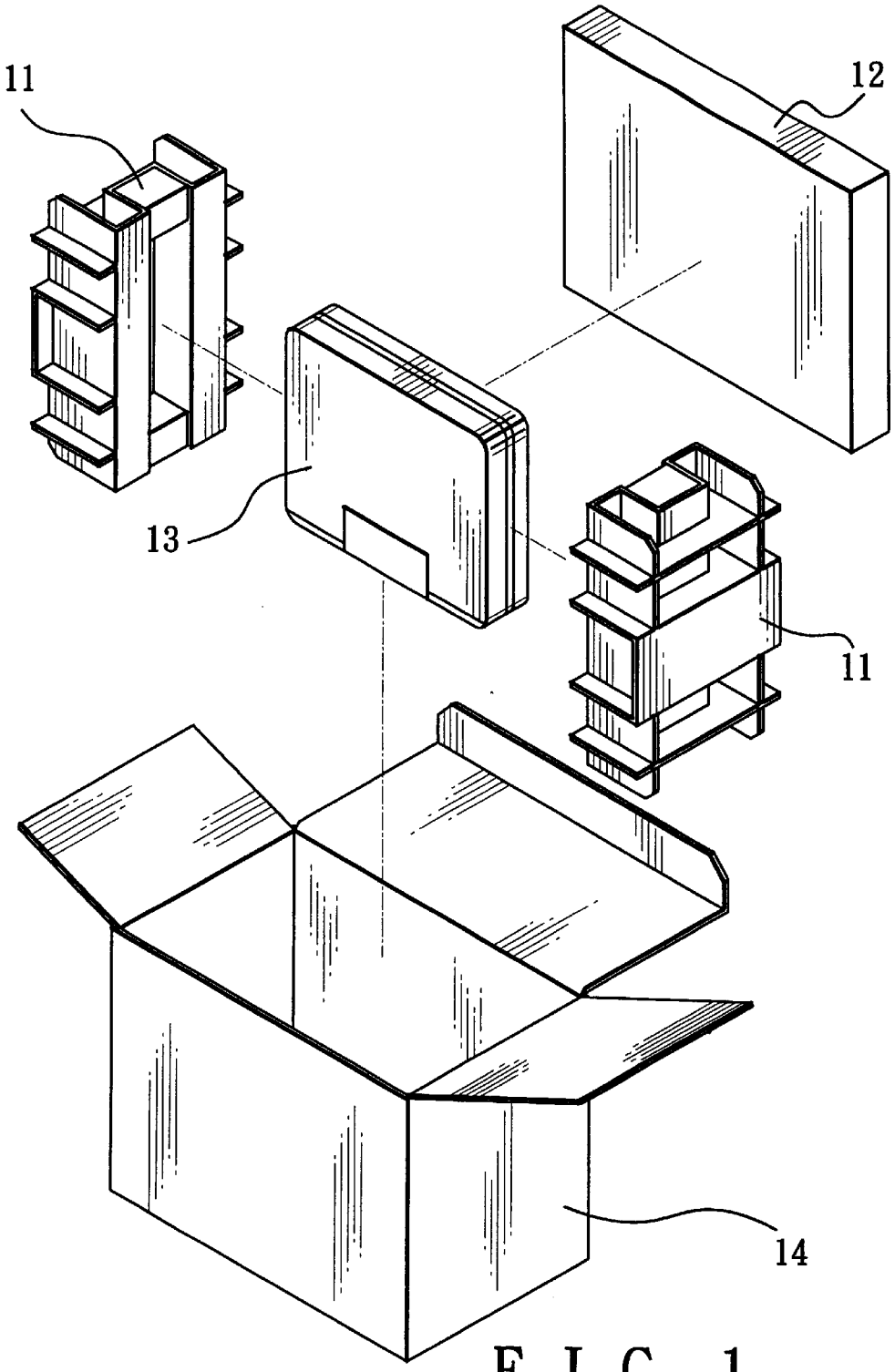
F I G. 1 PRIOR ART
FIG. 1 is an exploded view of a conventional packing buffer assembly for a notebook computer in a packing case.
Figure 2:
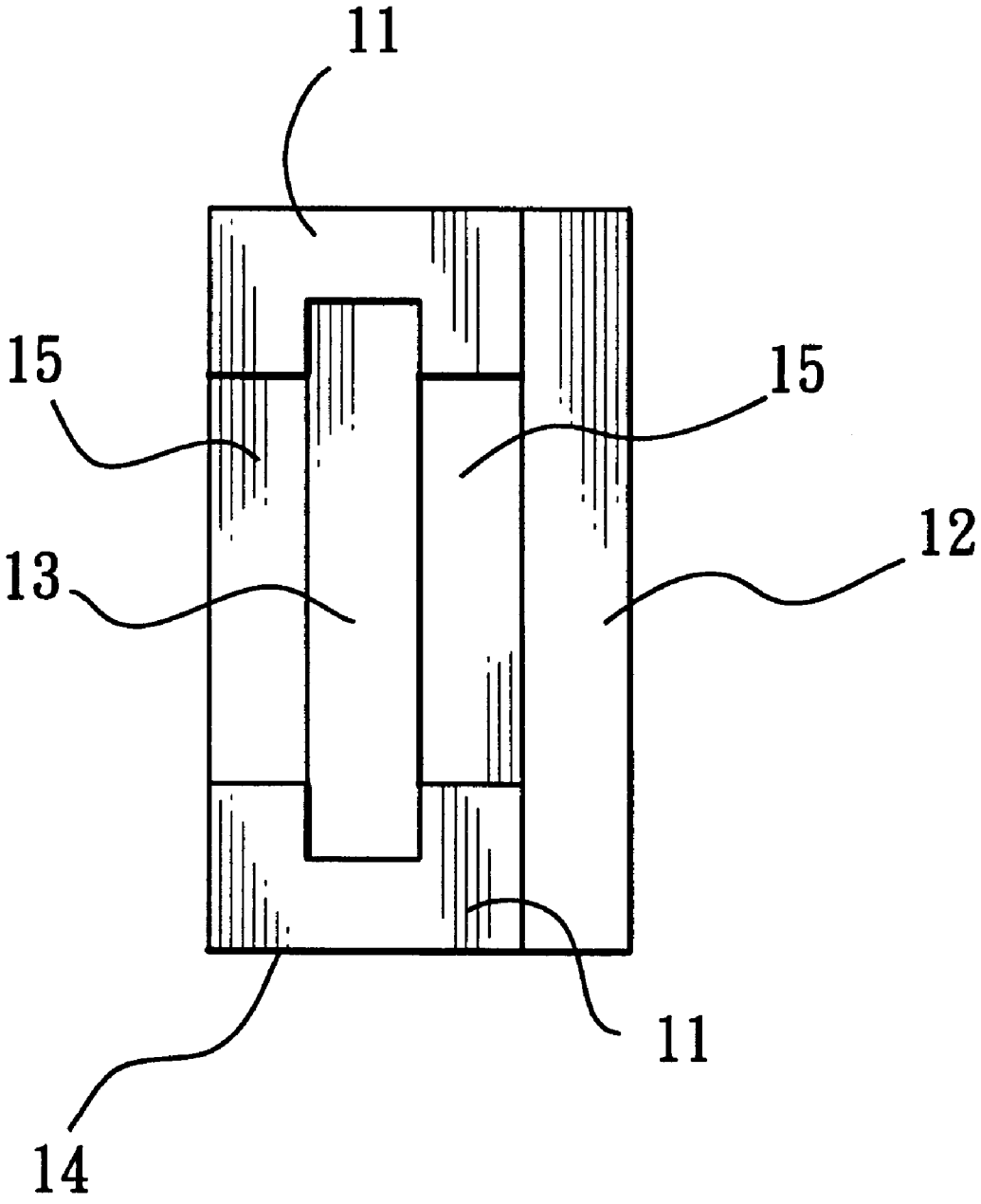
F I G. 2 PRIOR ART
FIG. 2 is a schematic top view of the packing buffer assembly with the notebook computer in the packing case.
Figure 3:
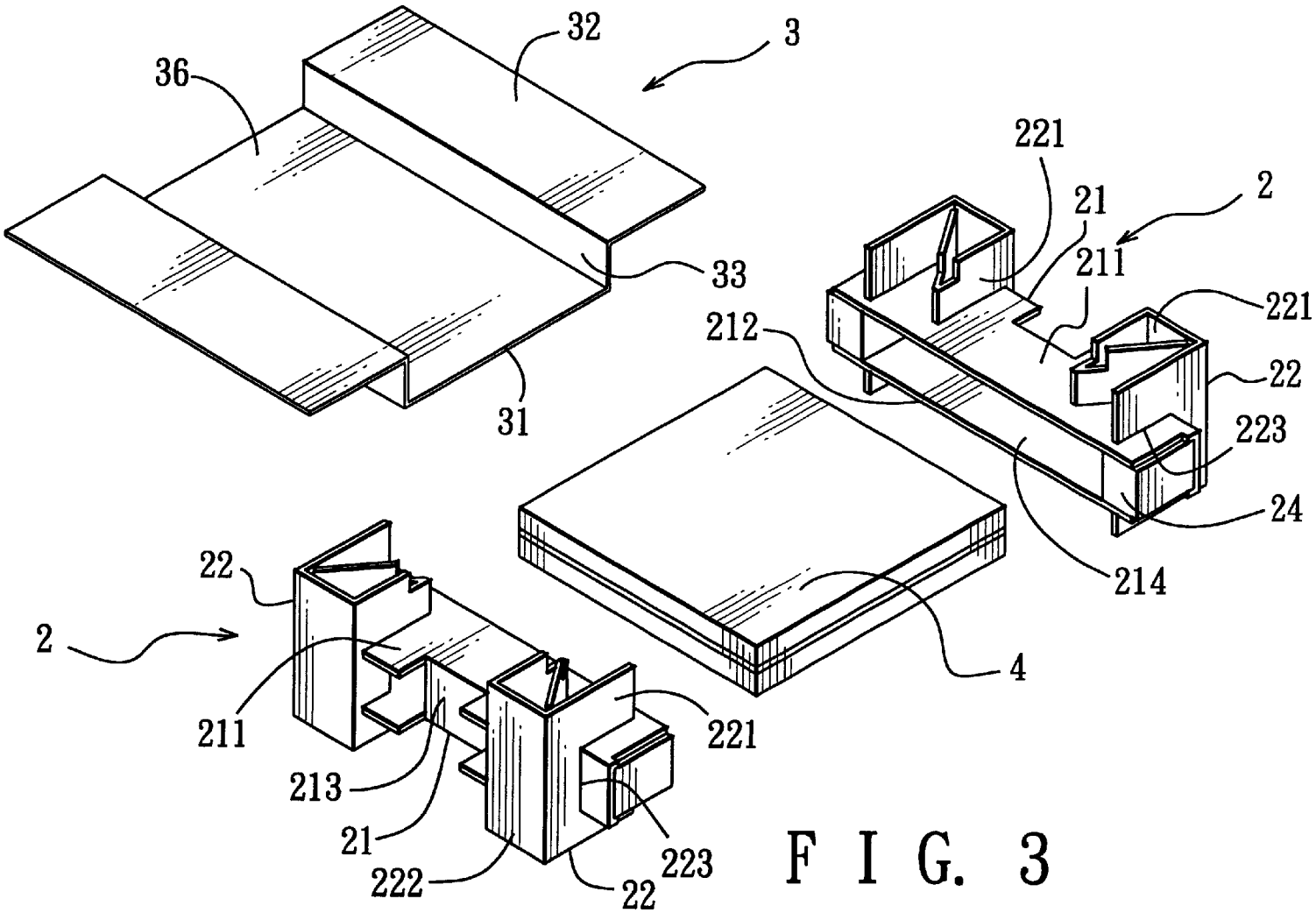
FIG. 3 is an exploded view illustrating an embodiment of a packing buffer assembly of this invention for a notebook computer.
Figure 4:
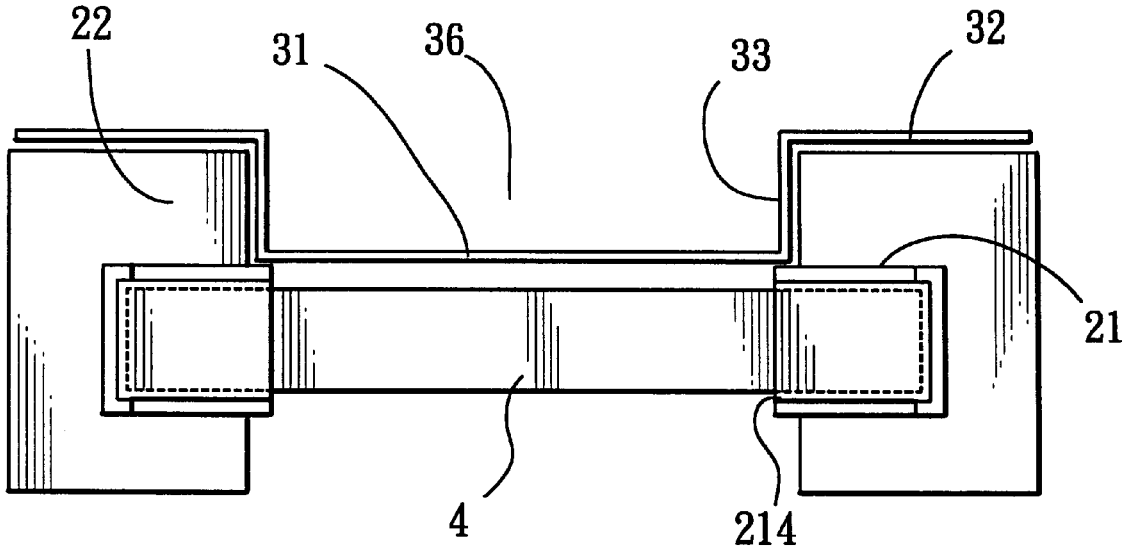
FIG. 4 is a side view showing the packing buffer assembly of FIG. 3 with the notebook computer received in the packing buffer assembly.
Figure 5:
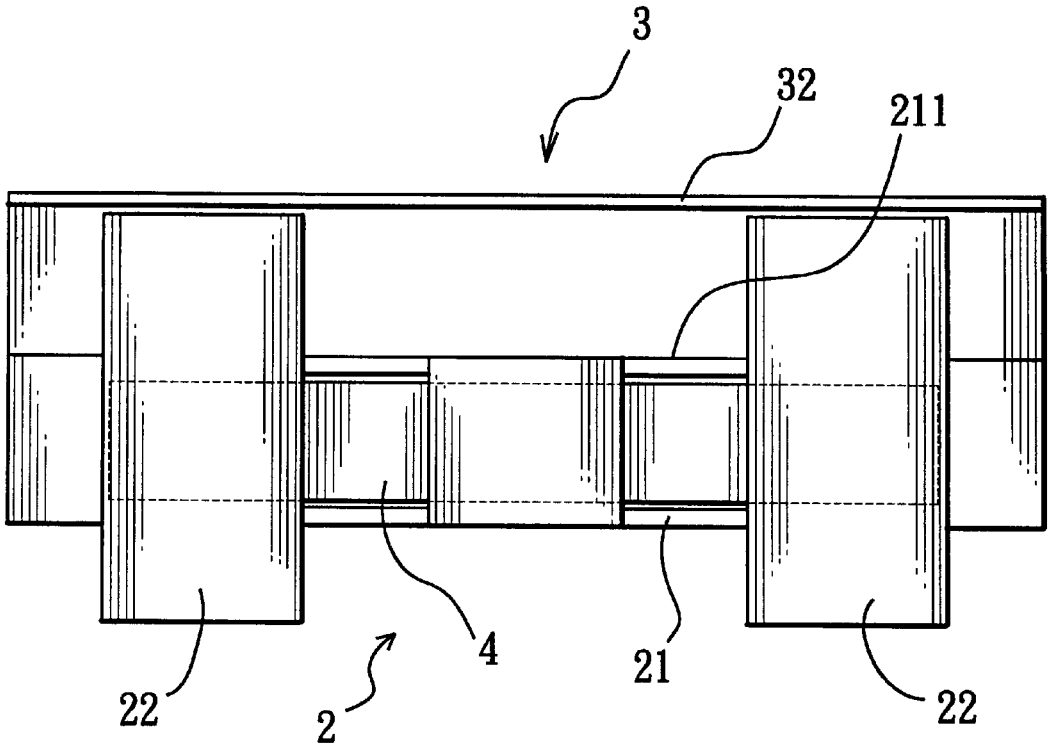
FIG. 5 is another side view of the packing buffer assembly of FIG. 3 showing the notebook computer received in the packing buffer assembly.

FIGS. 3 to 5 illustrate a packing buffer assembly embodying this invention. The packing buffer assembly includes a pair of spaced apart sleeves 2 which are adapted to receive two opposite sides of a notebook computer 4, and an accessory supporting plate 3 which is adapted to receive and to support accessories of the notebook computer 4, such as external disk drivers, program disks, manuals, power cords, batteries, and the like.

Each of the sleeves 2 has a horizontally extending substantially U-shaped first buffer member 21, a pair of vertically extending substantially U-shaped second buffer members 22 mounted respectively on two opposite ends of the first buffer member 21 in a wedging manner, and a pair of shoulder pads 24. The first buffer member 21 of each sleeve has a pair of horizontally extending upper and lower plates 211, 212 which are aligned and substantially parallel to each other, a vertically extending side plate 213 which interconnects the upper and lower plates 211, 212, and a horizontally extending first receiving space 214 that is confined by the upper and lower plates 211, 212 and the side plate 213. The shoulder pads 24 of each sleeve 2 are disposed in two opposite ends of the first receiving space 214 for spacing and propping the upper and lower plates 211, 212 of each first buffer member 21. The second buffer members 22 of each sleeve 2 is fitted over the first buffer member 21 at one side of the side plate 213 opposite to the first receiving space 214. Each second buffer member 22 has upper and lower end portions 221, 222 that respectively project upwardly and downwardly from the upper and lower plates 211, 212 of the respective first buffer member 21, and an intermediate notch 223 formed therein and disposed between the upper and lower end portions 221, 222 thereof. The first buffer member 21 of each sleeve 2 is inserted fittingly into the intermediate notches 223 of the respective pair of the second buffer members 22. The first receiving spaces 214 of the first buffer members 21 are adapted to receive respectively the opposite sides of the computer 4.

The accessory supporting plate 3 has a horizontally extending central part 31 which is aligned above and disposed adjacent to the computer 4, a pair of vertically extending risers 33 which extend respectively and upwardly from two opposite sides of the central part 31, a second receiving space 36 which is defined by the central part 31 and the risers 33 and which is adapted to receive and to support the accessories of the computer 4, and a pair of horizontally extending wings 32 which extend oppositely and respectively from top ends of the risers 33 to the upper end portions 221 of the second buffer members 22 of the sleeves 2 so as to be laid on the latter. Each of the wings 32 of the accessory supporting plate 3 is formed as a flat one-piece plate.

Figure 6:
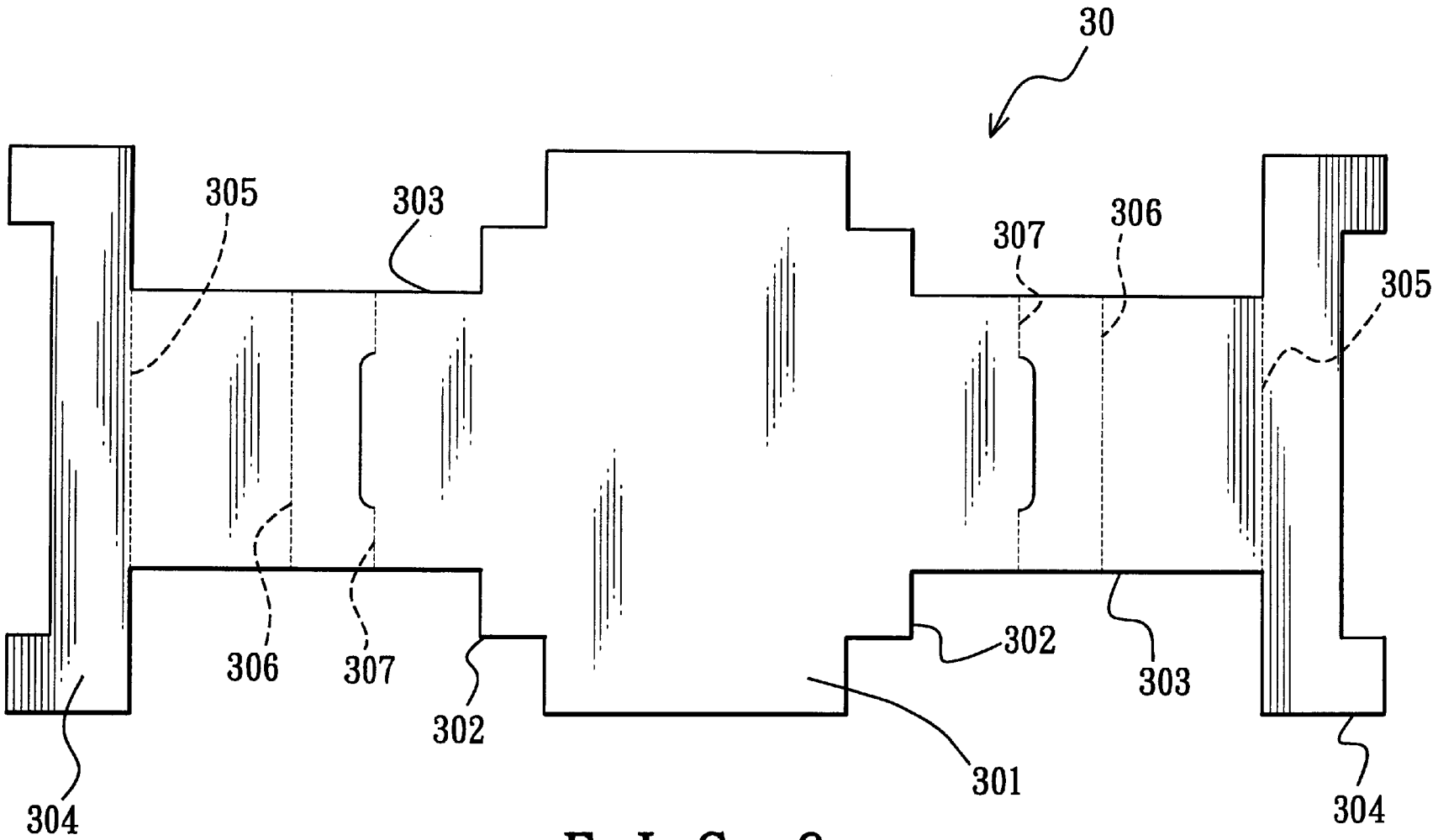
FIG. 6 is a top view illustrating another embodiment of an accessory supporting plate of the packing buffer assembly of FIG. 3 in an unfolded state.
Figure 7:
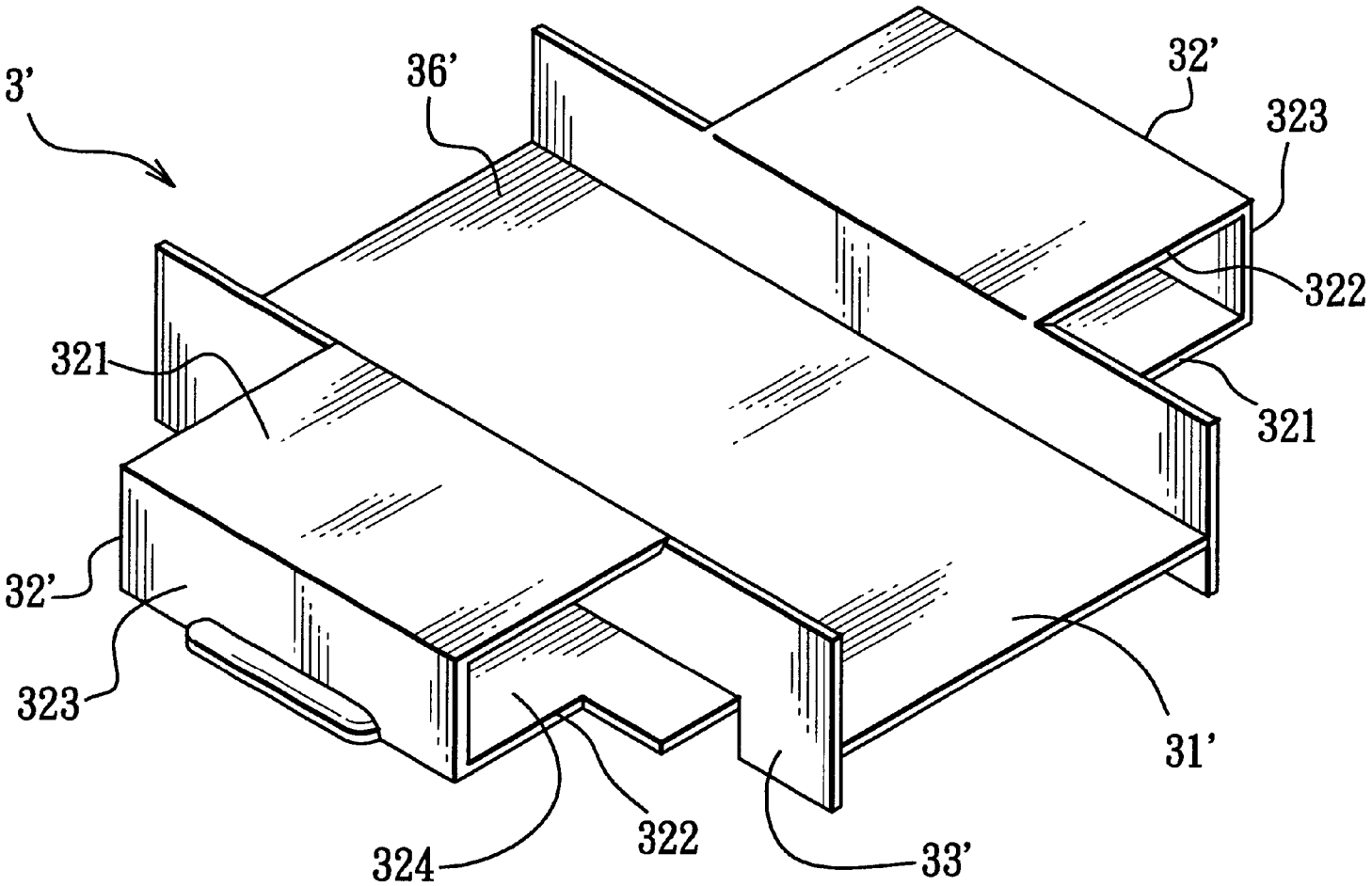
FIG. 7 is a perspective view of the accessory supporting plate of FIG. 6 in a folded state.
Figure 8:
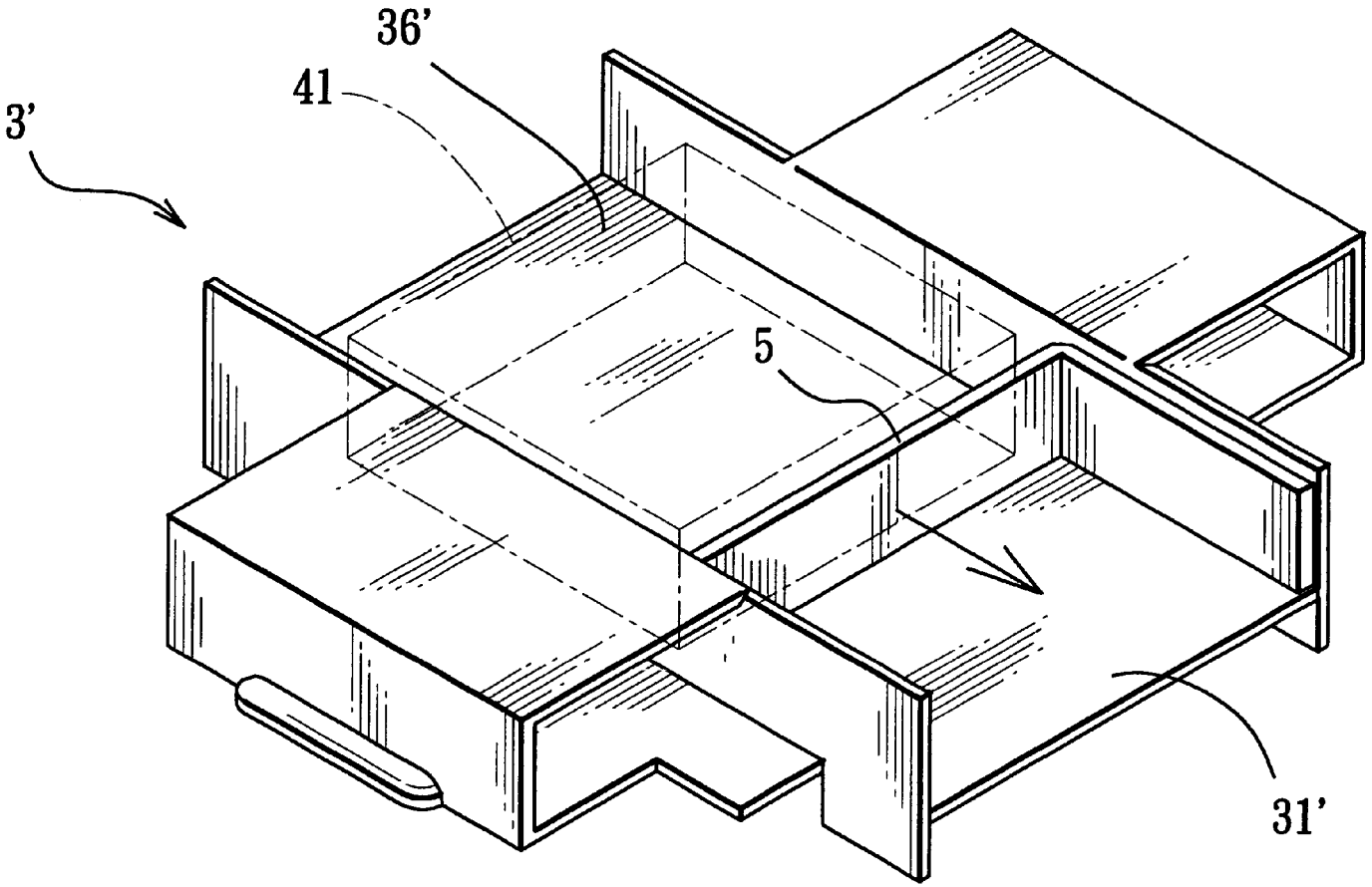
FIG. 8 is a perspective view of the accessory supporting plate of FIG. 6 provided with a positioning plate.

FIGS. 6 to 8 illustrate another embodiment of the packing buffer assembly of this invention. The packing buffer assembly is similar to the packing buffer assembly of the previous embodiment, except that the accessory supporting plate 3' of this embodiment has a structure different from that of the previous embodiment.

Referring now to FIGS. 7 and 8, in combination with FIG. 3, the accessory supporting plate 3' includes a horizontally extending central part 31', a pair of vertically extending risers 33' which extend respectively and upwardly from two opposite sides of the central part 31', a second receiving space 36' defined by the risers 33' and the central part 31' for receiving larger accessories of the computer 4, and a pair of wings 32'. Each of the wings 32' has a horizontally extending lower wing plate 322 that extends horizontally from a bottom end of the respective riser 33' to the upper plate 211 of the respective first buffer member 21 so as to be laid on the upper plate 211 between the upper end portions 221 of the respective pair of the second buffer members 22, a horizontally extending upper wing plate 321 that is disposed opposite to the lower wing plate 322 and that extends horizontally from a top end of the respective riser 33', and a vertically extending side wing plate 323 that interconnects and cooperates with the upper and lower wing plates 321, 322 to confine a third receiving space 324 for receiving smaller accessories of the computer 4. A substantially U-shaped positioning plate 5 is laid movably on the central part 31' within the second receiving space 36', and abuts against the risers 33' so as to position the larger accessories 41 of the computer 4.

Referring now to FIG. 6, in combination with FIGS. 7 and 8, the accessory supporting plate 3' is formed from a foldable one-piece blank plate 30 which includes a central section 301 that forms the central part 31', two opposite stepped sections 302 stepped immediately and respectively from two opposite sides of the central section 301, two opposite neck sections 303 that form the upper and lower wing plates 321, 322 and the side wing plates 323 of the wings 32' and that extend oppositely and respectively from the stepped sections 302, two opposite substantially U-shaped end sections 304 that form the risers 33' and that extend oppositely and respectively from the neck sections 303, two opposite first folding lines 305 formed between adjacent ones of the U-shaped end sections 304 and the neck sections 303, two opposite second folding lines 306 formed respectively on the neck sections 303, and two opposite third folding lines 307 formed respectively on the neck sections 303 between adjacent ones of the stepped sections 302 and the second folding lines 306. The blank plate 30 is folded along the first, second, and third folding lines 305, 306, 307 so as to form the accessory supporting plate 3'.

The use of the packing buffer assembly of this invention is not limited to the notebook computer 4, and can be used for other electrical appliances, such as printers, scanners, and the like.

With the invention thus explained, it is apparent that various modifications and variations can be made without departing from the spirit of the present invention. It is therefore intended that the invention be limited only as recited in the appended claims.

We claim:

1. A packing buffer assembly adapted to hold and to provide shock protection to a computer and accessories of the computer in a packing case, said packing buffer assembly comprising:

a pair of spaced apart sleeves adapted to receive tight two opposite sides of the computer, each of said sleeves having a horizontally extending substantially U-shaped first buffer member, a pair of vertically extending substantially U-shaped second buffer members mounted respectively on two opposite ends of said first buffer member in a wedging manner, and a pair of shoulder pads, said first buffer member of each of said sleeves having a pair of horizontally extending upper and lower plates which are aligned and substantially parallel to each other, a vertically extending side plate which interconnects said upper and lower plates, and a horizontally extending first receiving space that is confined by said upper and lower plates and said side plate, said shoulder pads of each of said sleeves being disposed in two opposite ends of said first receiving space for spacing and propping said upper and lower plates, said second buffer members of each of said sleeves being fitted over said first buffer member at one side of said side plate opposite to said first receiving space, and having upper and lower end portions that respectively project upwardly and downwardly from said upper and lower plates of said first buffer member, and intermediate notches formed between said upper and lower end portions, said first buffer member of each of said sleeves being inserted fittingly into said intermediate notches of the respective pair of said second buffer members, said first receiving spaces of said first buffer members being adapted to receive respectively the opposite sides of the computer; and an accessory supporting plate spanning said sleeves and having a horizontally extending central part which is adapted to be aligned above and disposed adjacent to the computer, a pair of vertically extending risers which extend respectively and upwardly from two opposite sides of said central part, a second receiving space which is defined by said central part and said risers and which is adapted to receive the accessories of the computer, and a pair of horizontally extending wings which extend oppositely and respectively from said risers so as to be laid on said sleeves.

2. The packing buffer assembly of claim 1, wherein said wings are formed as horizontally extending wing plates which extend horizontally and respectively from top ends of said risers to said upper end portions of said second buffer members so as to be laid on said upper end portions of said second buffer members.

3. The packing buffer assembly of claim 1, wherein said wings include horizontally extending lower wing plates which extend horizontally and respectively from bottom ends of said risers to said upper plates of said first buffer members so as to be laid on said upper plates of said first buffer members between said upper end portions of said second buffer members.

4. The packing buffer assembly of claim 3, wherein said wings further include horizontally extending upper wing plates which are disposed respectively opposite to said lower wing plates and which extend horizontally and respectively from said top ends of said risers, and vertically extending side wing plates, each of which interconnects said upper and lower wing plates of the respective one of said wings so as to cooperate with said upper and lower wing plates to confine a third receiving space that is adapted to receive the accessories of the computer.

5. The packing buffer assembly of claim 3, further comprising a substantially U-shaped positioning plate which is laid movably on said central part of said accessory supporting plate within said second receiving space and which is adapted to position the accessories of the computer.

6. The packing buffer assembly of claim 1, wherein said accessory supporting plate is formed from a foldable one-piece blank plate, said blank plate including a central section which forms said central part of said accessory supporting plate, two opposite stepped sections stepped immediately and respectively from two opposite sides of said central section, two opposite neck sections forming said wings and extending oppositely and respectively from said stepped sections, two opposite substantially U-shaped end sections forming said risers and extending oppositely and respectively from said neck sections, two opposite first folding lines formed between adjacent ones of said U-shaped end sections and said neck sections, two opposite second folding lines formed respectively on said neck sections, and two opposite third folding lines formed respectively on said neck sections between adjacent ones of said stepped sections and said second folding lines, said blank plate being folded along said first, second, and third folding lines so as to form said accessory supporting plate.

* * * * *